US006702538B1

(12) United States Patent
Heinicke et al.

(10) Patent No.: US 6,702,538 B1
(45) Date of Patent: Mar. 9, 2004

(54) METHOD AND APPARATUS FOR FORMING A CAN END WITH MINIMAL WARPAGE

(75) Inventors: Paul R. Heinicke, Canton, OH (US); William A. Kirk, Massillon, OH (US)

(73) Assignee: Crown Cork & Seal Technologies Corporation, Philadelphia, PA (US)

( * ) Notice: Subject to any disclaimer, the term of this patent is extended or adjusted under 35 U.S.C. 154(b) by 0 days.

(21) Appl. No.: 09/503,816

(22) Filed: Feb. 15, 2000

(51) Int. Cl.[7] ..... B21D 51/44
(52) U.S. Cl. ..... 413/8; 413/56; 413/62
(58) Field of Search ..... 413/8, 56, 62; 220/66, 67; 72/348, 715

(56) References Cited

U.S. PATENT DOCUMENTS

| | | | | |
|---|---|---|---|---|
| 3,941,277 A | | 3/1976 | McKinney et al. | 220/273 |
| 4,217,843 A | * | 8/1980 | Kraska | 413/62 |
| 4,434,641 A | * | 3/1984 | Nguyen | 413/8 |
| 4,467,933 A | | 8/1984 | Wilkinson et al. | 220/66 |
| 4,577,774 A | | 3/1986 | Nguyen | 220/66 |
| 4,790,705 A | * | 12/1988 | Wilkinson et al. | 413/56 |
| 4,796,772 A | | 1/1989 | Nguyen | 220/66 |
| 4,832,223 A | * | 5/1989 | Kalenak et al. | 220/66 |
| 5,024,077 A | | 6/1991 | Bulso, Jr. et al. | 72/336 |
| 5,149,238 A | * | 9/1992 | McEldowney et al. | 72/348 |
| 5,356,256 A | * | 10/1994 | Turner et al. | 72/348 |
| 5,381,683 A | | 1/1995 | Cowling | 72/329 |
| 5,527,143 A | | 6/1996 | Turner et al. | 413/8 |
| 5,685,189 A | * | 11/1997 | Nguyen et al. | 413/8 |
| 5,749,488 A | | 5/1998 | Bagwell et al. | 220/269 |
| 5,823,040 A | | 10/1998 | Stodd | 72/392 |
| 5,987,956 A | | 11/1999 | Strube et al. | 72/348 |

FOREIGN PATENT DOCUMENTS

DE 299 06 170 U1 9/1999

OTHER PUBLICATIONS

"The End of the 'Potato Chip'" The Canmaker pp. 36–37 (Feb. 2000).

* cited by examiner

*Primary Examiner*—John Sipos
*Assistant Examiner*—Louis Huynh
(74) *Attorney, Agent, or Firm*—Woodcock Washburn LLP

(57) ABSTRACT

A method of forming a can end comprises the step of forming a substantially circular metal blank having a periphery and a center panel. An annular recessed panel is subsequently formed in the blank. The recessed panel has a first depth in relation to a substantially annular portion of the blank contiguously formed with the recessed panel. The substantially annular portion of the blank is then coined while the recessed panel is re-formed to a second depth in relation to the substantially annular portion of the blank. The second depth is greater than the first depth. Forming the can end in this manner minimizes warpage of the can end, and thereby allows the can end to be formed from a relatively thin sheet of metal.

12 Claims, 8 Drawing Sheets

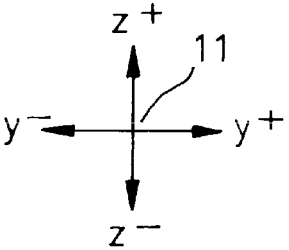
Fig.5B.
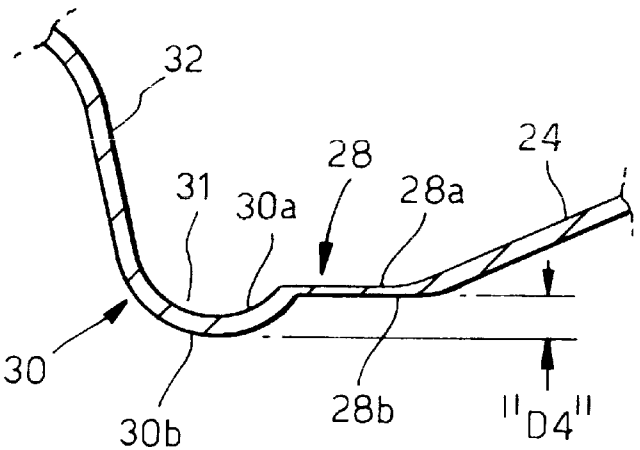
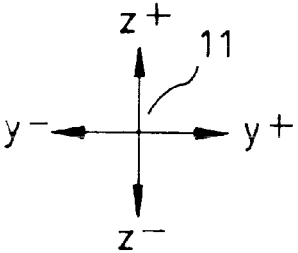
Fig.5A.
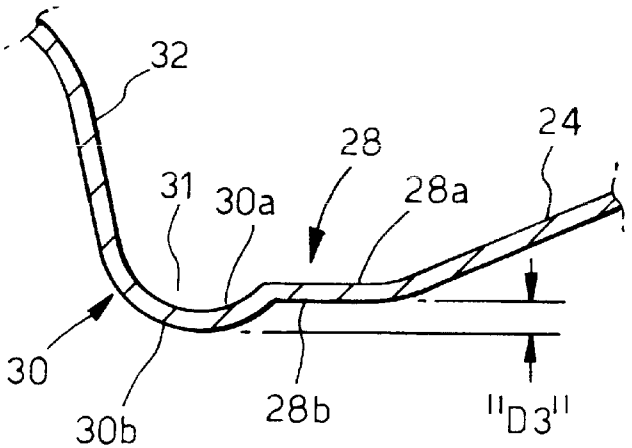

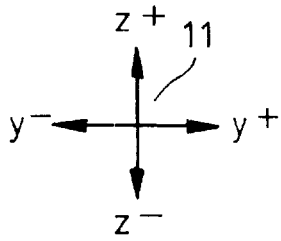
Fig.6A.
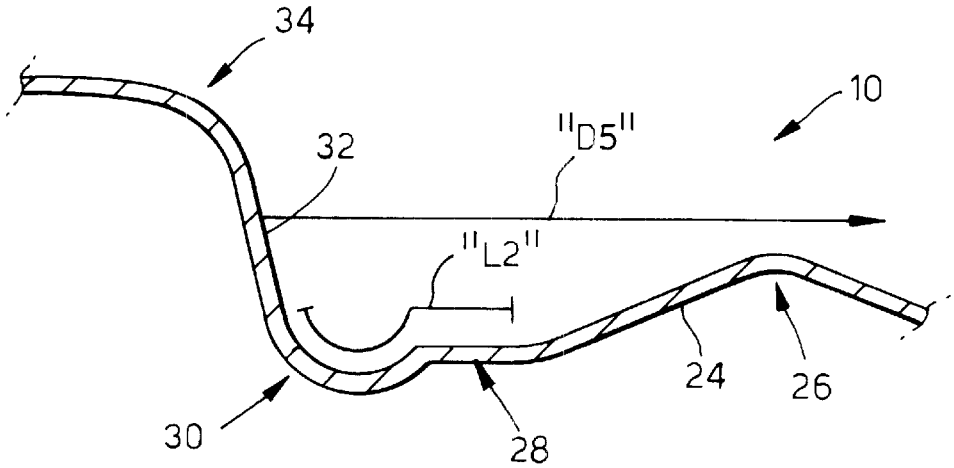
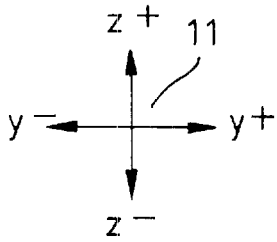
Fig.6B.
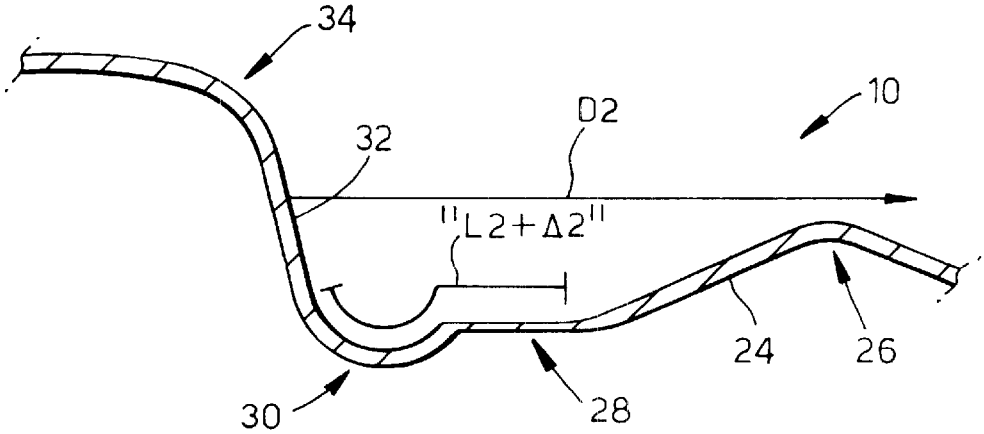

METHOD AND APPARATUS FOR FORMING A CAN END WITH MINIMAL WARPAGE

FIELD OF THE INVENTION

The present invention relates to ends for can-type containers. More specifically, the invention pertains to a method and an apparatus for manufacturing a relatively thin can end with minimal warpage.

BACKGROUND OF THE INVENTION

Can-type containers used for the storage of food products often comprise a body and two ends fixed to the body. Manufacturers of can ends, in general, make substantial efforts to reduce the thickness of the can ends which they produce. Reducing the thickness of a can end lowers the amount of material needed to manufacture the can end, and thereby leads to cost savings. For example, thickness reductions as small as one-thousandth of an inch or less can yield substantial cost savings over time due to the relatively large production volumes of typical can ends. Hence, the ability to manufacture can ends from relatively thin sheets of material offers substantial benefits. For example, the use of double-reduced steel in the manufacture of can ends is particularly advantageous because double-reduced steel provides a favorable combination of thinness, tensile strength, hardness, and resistance to elongation.

Reducing the thickness of a can end, however, increase the potential for the can end to warp during manufacture. Can ends manufactured from materials formed by rolling, e.g., double-reduced steels, are particularly susceptible to such warpage. In particular, the rolling operation induces a direction-dependent non-uniformity in the mechanical properties of the can end, i.e., rolling causes the mechanical properties of the can end to vary in different directions. This non-uniformity induces a tendency in the can end to warp. Warpage of a can end inhibits the effective mating of the can end and the can body. In addition, warpage can interfere with the automated transfer (feeding) of the can end during subsequent processing operations, e.g., lining of the can end. Hence, can-end warpage is highly undesirable and should be minimized or eliminated.

Warpage of a can end can be reduced by coining an annularly-shaped area on the can end. Coining substantially reduces the directional non-uniformity in the mechanical properties of the coined area, and thereby lowers or eliminates the tendency of the can end to warp. Coining, however, usually increases the diameter of the can end. In particular, the coining operation causes material within the coined area to be displaced. The displacement of material in this manner usually causes an increase in the chuck-wall diameter of the can end. Increases in chuck-wall diameter can inhibit the effective mating of the can end and the can body. Furthermore, increases in the chuck-wall diameter can prevent a proper fit between the can end and the seaming chuck utilized to join the can end to a can body. Hence, increases in chuck-wall diameter resulting from the coining operation should be minimized or eliminated.

The above-described increase in chuck-wall diameter is illustrated in FIGS. 13A and 13B. FIG. 13A shows a can end 100 having a chuck wall 102 and a panel 104. FIG. 13A depicts the can end 100 before the panel 104 is coined. The panel 104 has an initial length denoted by the symbol "L1." The can end 100 has an initial chuck-wall diameter represented by the symbol "D1."

FIG. 13B depicts the can end 100 after the panel 104 has been coined. The material displaced by the coining operation increases the overall length of the coined panel 104 by an amount represented by the symbol "Δ1." Hence, the overall length of the panel 104 after the coining operation equals the initial length (L1) plus the increase in the length of the panel 104 caused by the coining operation (Δ1). The increase in the length of the panel 104 causes a corresponding increase in the chuck wall diameter of the can end 100. Specifically, the chuck-wall diameter after the coining operation is approximately equal to the initial chuck-wall diameter (D1) plus the change in the length of the panel 104 (Δ1).

The above discussion illustrates the current need for a method and an apparatus for manufacturing a relatively thin can end with minimal warpage. More particularly, a method and an apparatus are needed for reducing the tendency of thin can ends to warp during manufacture, without substantially affecting the chuck-wall diameter of the can ends. The present invention is directed to these and other goals.

SUMMARY OF THE INVENTION

An object of the present invention is to provide a method of forming a can end with minimal warpage. In accordance with this object, a presently-preferred method of forming a can end comprises the step of forming a substantially circular metal blank having a periphery and a center panel. The method also comprises the step of forming a substantially annular recessed panel in the blank. The recessed panel has a first depth in relation to a substantially annular portion of the blank contiguously formed with the recessed panel. The method further comprises the step of coining the substantially annular portion of the blank while re-forming the recessed panel to a second depth in relation to the substantially annular portion of the blank, with the second depth being greater than the first depth.

Further in accordance with the above-noted object, another presently-preferred method of forming a can end comprises the step of forming a substantially circular metal blank having a periphery and a center panel. The method also comprises the step of forming a substantially annular recessed panel in the blank. The recessed panel has a depth in relation to a substantially annular portion of the blank contiguously formed with the recessed panel. The method further includes the step of coining the substantially annular portion of the blank while the recessed panel is being formed, and after the depth of the recessed panel reaches a predetermined value.

Another object of the present invention is to provide a method for minimizing warpage of a can end. In accordance with this object, a presently-preferred method of minimizing warpage of a can end comprises the step of partially forming a substantially annular recess in the can end and then fully forming the recess while coining a substantially annular area of the can end bordering the recess.

A further object of the present invention is to provide an apparatus for forming a can end with minimal warpage. In accordance with this object, a presently-preferred embodiment of a die for forming a can end comprises an annular cut edge having an inner circumferential surface. The die also comprises a punch coaxially disposed with the cut edge. The punch and the cut edge are adapted to form a metal blank having a periphery and a center panel.

The die further comprises means for forming an annular recessed panel in the blank. The recessed panel has a first depth in relation to a substantially annular portion of the blank contiguously formed with the recessed panel. The die also comprises means for coining the substantially annular portion of the blank while re-forming the recessed panel to a second depth in relation to the substantially annular portion of the blank. The second depth is greater than the first depth.

BRIEF DESCRIPTION OF THE DRAWINGS

The foregoing summary, as well as the following detailed description of a presently-preferred embodiment, is better understood when read in conjunction with the appended drawings. For the purpose of illustrating the invention, the drawings show an embodiment that is presently preferred. The invention is not limited, however, to the specific instrumentalities disclosed in the drawings. In the drawings:

FIG. 5A is a magnified view of the area designated "5A" in FIG. 4D;

FIG. 5B is a magnified view of the area designated "5B" in FIG. 4E;

FIG. 6A is a cross-sectional view of the can end shown in FIGS. 1 though 5B prior to being coined in accordance with the present invention;

FIG. 6B is a cross-sectional view of the can end shown in FIGS. 1 through 6A after being coined in accordance with the present invention;

DESCRIPTION OF PREFERRED EMBODIMENTS

The present invention provides a method and an apparatus for forming a can end with minimal warpage. A can end 10 produced in accordance with the present invention is shown in FIGS. 1 through 6B. The figures are referenced to a common coordinate system 11 denoted in each illustration. The can end 10 is described in detail herein for exemplary purposes only. The invention is equally applicable to the formation of can ends having structural features that differ from those of the exemplary can end 10.

Figure 3:
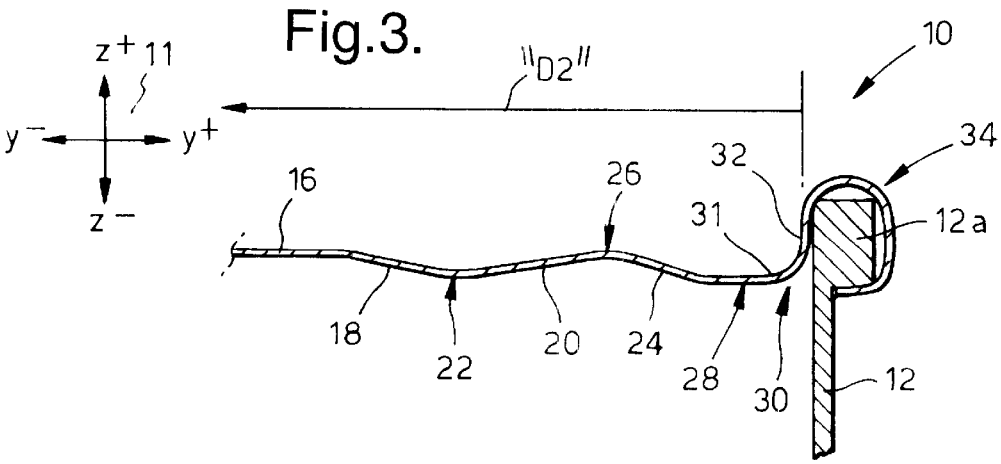
FIG. 3 is a cross-sectional view of the can end shown in FIGS. 1 and 2 configured to engage a lip of a can body (not shown)

The can end 10 is used in conjunction with a can body 12 (a limited portion of the can body 12 is shown in FIG. 3). Specifically, one of the can ends 10 is fixed to a top of the can body 12, and another of the can ends 10 (not shown) is fixed to a bottom of the can body 12. The can ends 10 and the can body 12 form a container that may be used, for example, to store vacuum-packed food products.

Figure 1:
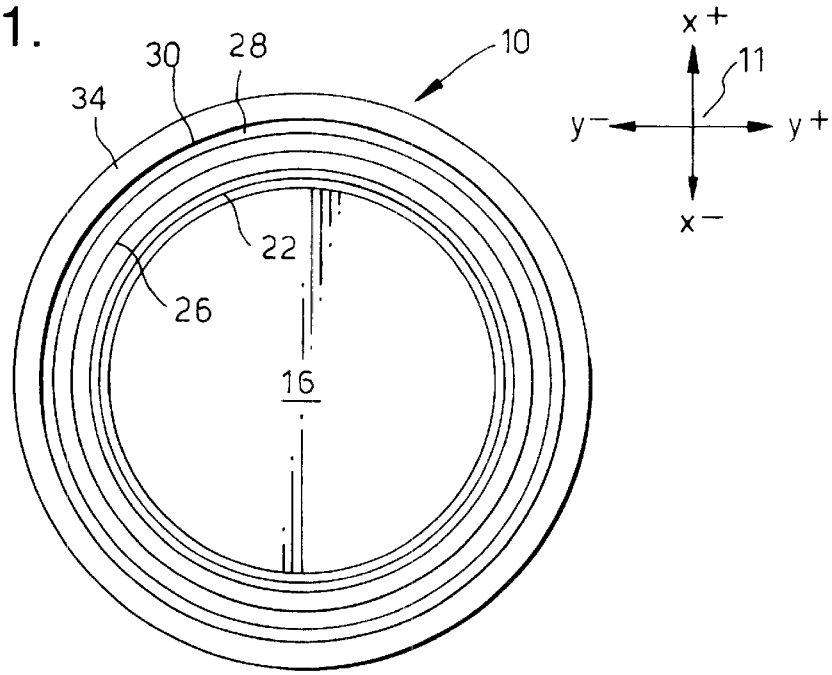
FIG. 1 is a top view of a can end formed in accordance with the present invention.
Figure 2:
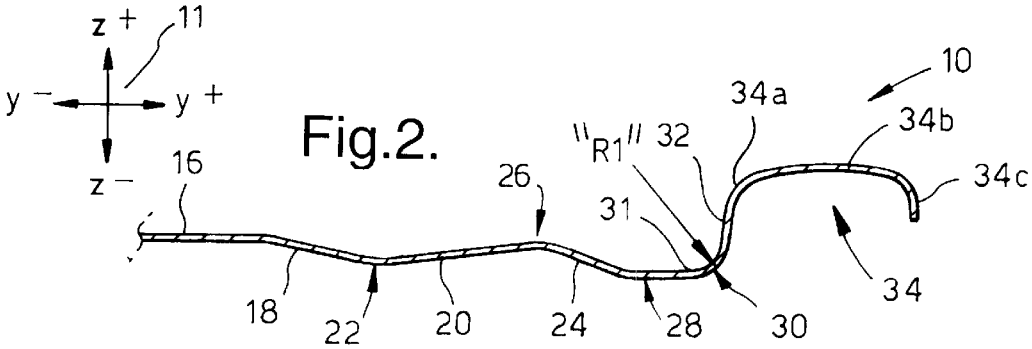
FIG. 2 is a cross-sectional view of the can end shown in FIG. 1 before the can end is fixed to a can body.

The exemplary can end 10 is formed from double-reduced steel such as DR8 65-pound continuous-annealed steel (the invention can also be used in conjunction with batch-annealed steel, and with 55-pound (or lower) steel). FIG. 2 is a detailed view of an outermost portion of the can end 10 before the can end 10 is joined to the can body 12. FIG. 3 shows the same portion of the can end 10 after the can end 10 is joined to the can body 12.

The thickness of the can end 10 is approximately 0.0072 inch (0.18 mm), except where otherwise noted below (this value is based on the use of DR8 65-pound steel). The can end 10 comprises a substantially circular center panel 16. The center panel 16 is substantially flat, i.e., the center panel 16 lies substantially in the x-y plane denoted in the figures. The can end 10 further includes an annular first angled panel 18. The first angled panel 18 is contiguously formed with the center panel 16, i.e., the first angled panel 18 adjoins the center panel 16. The first angled panel 18 slopes downward, i.e., in the $z^-$ direction, as it extends radially outward from the center panel 16. A second angled panel 20 is contiguously formed with the first angled panel 18. The second angled panel 20 is annular, and slopes upward as it extends radially outward from the first angled panel 18. The first and the second angled panels 18 and 20 form a downwardly-extending stiffening bead 22.

The can end 10 also includes a third angled panel 24. The third angled panel 24 is contiguously formed with the second angled panel 20. The third angled panel 24 is annular, and slopes downward as it extends radially outward from the second angled panel 20. The second and the third angled panels 20 and 24 form an upwardly-extending stiffening bead 26.

In accordance with the present invention, a coined panel 28 is contiguously formed with the third angled panel 24. The coined panel 28 extends radially outward from the third angled panel 24. The coined panel 28 is substantially flat, i.e., the coined panel 28 lies substantially in the x-y plane denoted in the figures. The coined panel 28 has an upper surface 28*a* and an opposing lower surface 28*b*, as is most clearly shown in FIGS. 5A and 5B (FIGS. 5A and 5B respectively show the coined panel 28 in its initial (uncoined) and final (coined) states). The panel 28 has a thickness of approximately 0.0072 inch (0.18 mm) before the panel 28 is coined. The panel 28 preferably has a thickness within the range of approximately 0.0062 inch to 0.0068 inch (0.16 mm to 0.17 mm) after the coining operation (these values are based on the use of DR8 65-pound steel). The width (radial dimension) of the coined panel 28 is approximately 0.060 inch (1.5 mm) after the panel 28 is coined. The function of the coined panel 28 is described below.

Further in accordance with the present invention, a recessed panel 30 is contiguously formed with the coined panel 28. The recessed panel 30 has an upper surface 30*a* and a lower surface 30*b*, as is most clearly shown in FIGS. 5A and 5B. The recessed panel 30 has a substantially arcuate cross-section. The upper surface 30*a* of the recessed panel 30 preferably has a radius of curvature R1 within the range of approximately 0.035 inch to 0.039 inch (0.89 mm to 0.99 mm) when the recessed panel 30 is fully formed (see FIG. 2). The recessed panel 30 initially curves downward as it extends radially outward from the coined panel 28. The recessed panel 30 eventually curves upward as the panel 30 continues to extend radially outward from the coined panel 28.

The recessed panel 30 preferably has a depth of approximately 0.0030 inch (0.076 mm) when the recessed panel 30 is fully formed. The depth of the fully-formed recessed panel 30 is denoted by the symbol "D4" in FIG. 5B. The depth D4 represents the vertical (z-axis) distance between the bottom surface 28*b* of the coined panel 28 and the lowest point on the bottom surface 30*b* of the recessed panel 30. The upper surface 30*a* of the recessed panel 30 defines a recess 31 (see, e.g., FIGS. 5A and 5B). The significance of the recess 31 and the recessed panel 30 are explained in detail below.

The can end 10 further includes an annular chuck wall 32. The chuck wall 32 is contiguously formed with the recessed panel 30 and extends substantially in the vertical (z) direction. The chuck wall 32 defines a chuck-wall diameter. The chuck-wall diameter of the fully-formed can end 10 is denoted by the symbol "D2" in FIG. 3. The chuck-wall diameter D2 of the exemplary can end 10 is within the range of approximately 3.882 inches to 3.886 inches (98.60 mm to 98.70 mm).

A seaming panel 34 is contiguously formed with the chuck wall 32. The seaming panel 34 is utilized to join the can end 10 to the can body 12 through a conventional seaming operation. The seaming panel 34 includes a first portion 34*a* and a second portion 34*b* contiguously formed with the first portion 34*a*. The seaming panel 34 also includes a third portion 34*c* contiguously formed with the second portion 34*b*.

The seaming panel 34 has the following structural characteristics before the seaming panel 34 is joined to the can body 12. The first portion 34*a* of the seaming panel 34 has a substantially arcuate cross section, and extends upward and radially outward from the chuck wall 32. The first portion 34*a* preferably has a radius of curvature of approximately 0.043 inch (1.1 mm). The second portion 34*b* has a substantially arcuate cross section, and extends primarily radially outward from the first portion 34*a*. The second portion 34*b* preferably has a radius of curvature of approximately 0.259 inch (6.58 mm). The third portion 34*c* extends downward and radially outward from the second portion 34*b*. The cross section of the third portion 34*c* is substantially arcuate where the third portion 34*c* meets the second portion 34*b*. The cross section of the third portion 34*c* becomes substantially straight as the third portion 34*c* continues to extend away from the second portion 34*b* (see FIG. 2). The arcuate section of the third portion 34*c* preferably has a radius of curvature of approximately 0.029 inch (0.74 mm).

The seaming panel 34 is joined to the can body 12 by placing the seaming panel 34 over a cover hook 12*a* disposed along an upper (or lower) edge of the can body 12 (see FIG. 3). The third portion 34*a* of the seaming panel 34 is subsequently deformed downward and radially inward so that the seaming panel 34 is secured around the lip 12*a*. This action secures the can end 10 to the can body 12. The can end 10 preferably has a diameter within the range of approximately 4.266 inches to 4.274 inches (108.4 mm to 108.6 mm) after the can end 10 has been joined to the can body 12.

Figure 4A:
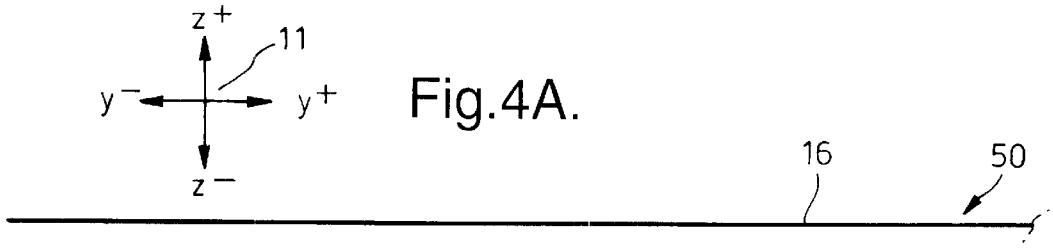
FIGS. 4A through 4E are cross-sectional views of a metal blank being progressively formed into the can end shown in FIGS. 1 through 3.
Figure 4B:
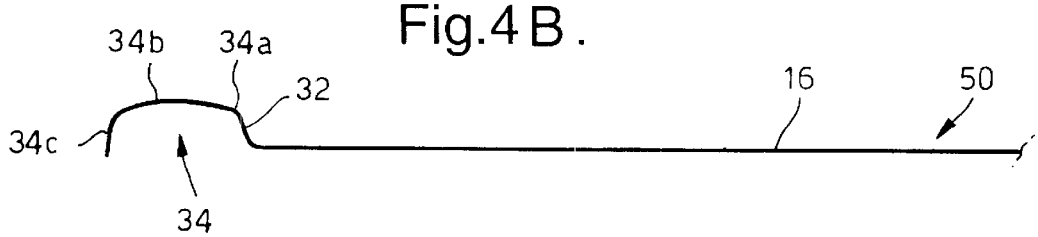
Figure 4C:
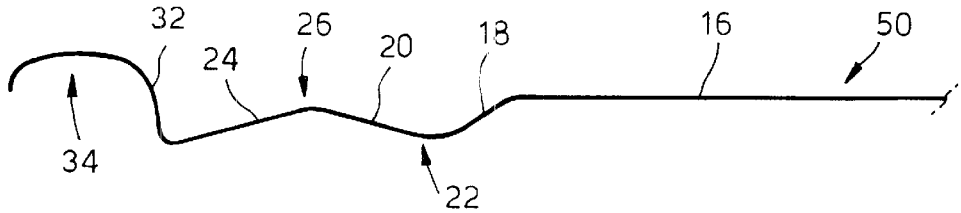

Details relating to the formation of the can end 10 are as follows. FIGS. 4A through 4E show the successive stages of the geometry of the can end 10 as the can end 10 is formed according to the current invention. The process of forming the can end 10 commences with the cutting of a substantially circular metal blank 50 from a sheet of metal such as DR8 65-pound continuous-annealed steel (the invention can also be used in conjunction with batch-annealed steel and 55-pound (or lower) steel, as noted previously). The blank 50 includes the center panel 16, as shown in FIG. 4A. The blank 50 is then stamped along its outer periphery to form the seaming panel 34 (see FIG. 4B). The stiffening beads 22 and 26 are subsequently formed radially outward of the center panel 16, as shown in FIG. 4C.

Figure 4D:
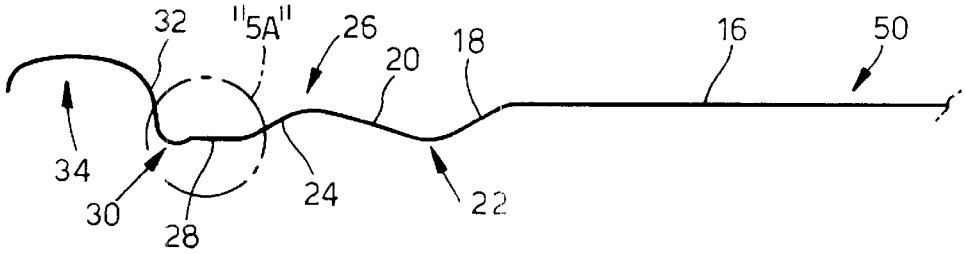

The recessed panel 30 and the coined panel 28 are initially formed on a substantially simultaneous basis after the stiffening beads 22 and 26 have been formed (see FIGS. 4D and 5A). Specifically, the area on the blank 50 directly inward of the recessed panel 30 is stamped so as to lie substantially flat in relation to the x-y plane. In addition, the recessed panel 30 is formed to an initial depth (this action also initially forms the recess 31). The initial depth of the recessed panel 30 is denoted by the symbol "D3" in FIG. 5A. The depth D3 represents the vertical (z-axis) distance between the bottom surface 28*b* of the initially-formed coined panel 28 and the lowest point on the bottom surface 30*b* of the recessed panel 30. The initial depth D3 of the recessed panel 30 is preferably approximately 0.0025 inch (0.064 mm).

Figure 4E:
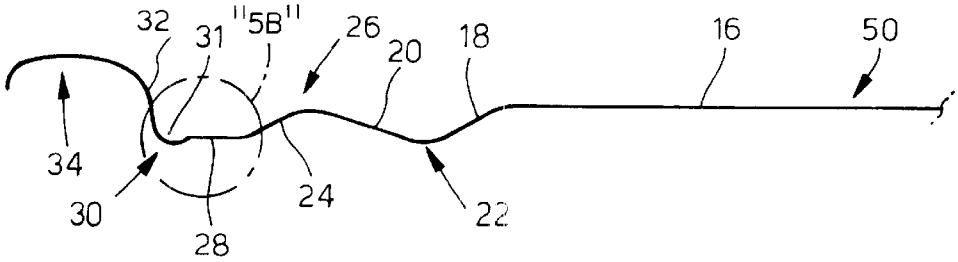
Figure 7:
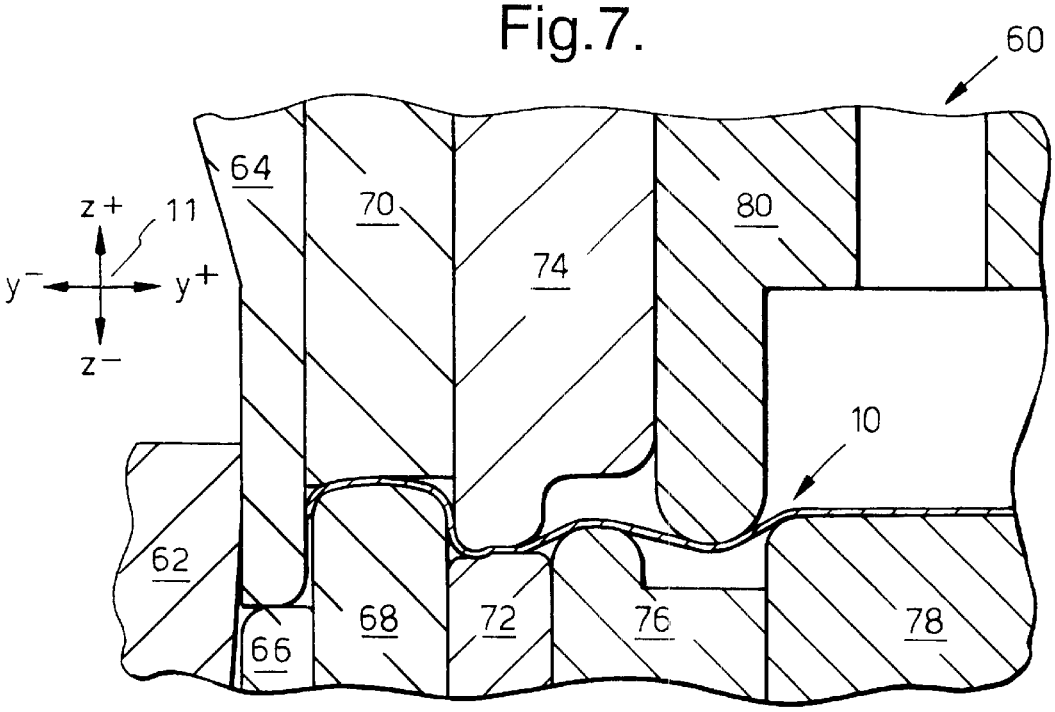
FIG. 7 is a cross-sectional view of a die for forming the can end shown in FIGS. 1 through 6B.
Figure 8:
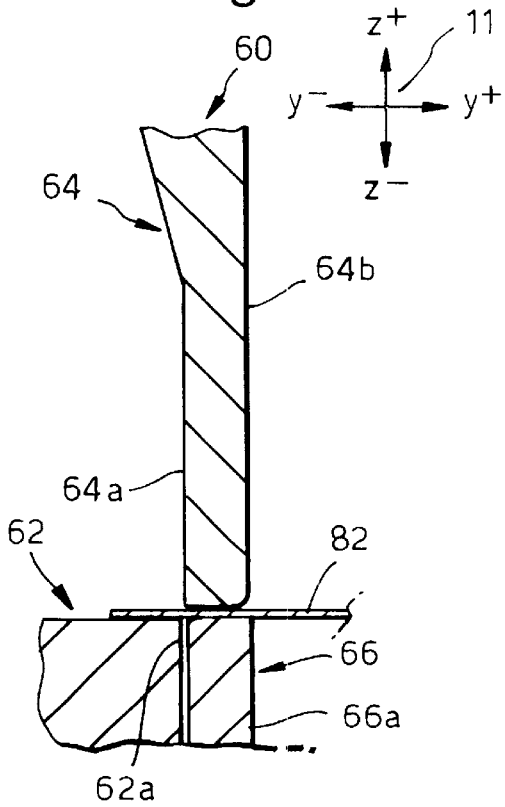
FIG. 8 is a cross-sectional view of the die shown in FIG. 7 prior to forming a blank from a metal sheet positioned on the die.
Figure 9:
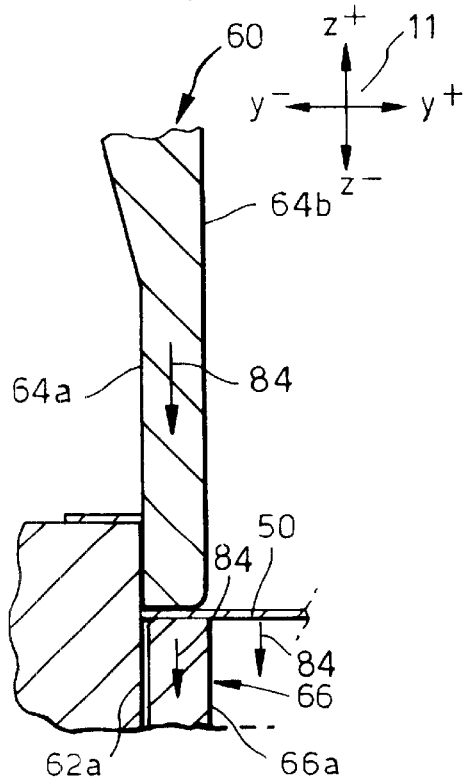
FIG. 9 is a cross-sectional view of the die shown in FIGS. 7 and 8 after a blank is cut from the metal sheet shown in FIG. 8.

In accordance with the present invention, the panel 28 is coined after the recessed panel 30 and the panel 28 have been initially formed in the above-noted manner (see FIGS. 4E and 5B). The coining operation reduces the thickness of the coined panel 28. (The reduction in the thickness of the coined panel 28 is exaggerated in FIG. 5B for clarity.) The thickness of the panel 28 is approximately 0.0072 inch (0.18 mm) before the coining operation, as noted previously. The coining operation reduces the thickness of the panel 28 to its final value within the range of approximately 0.0062 inch to 0.0068 inch (0.16 mm to 0.17 mm).

The recessed panel 30 is re-formed into its final configuration on a simultaneous basis with the coining operation, i.e., the recessed panel 30 is formed to its final depth D4 as the panel 28 is coined (this action also re-forms the recess 31 into its final configuration). (Differences between the initial depth D3 and the final depth D4 of the recessed panel 30 are exaggerated in FIGS. 5A and 5B for clarity). The can end 10 is fully formed at this point, and is ready to be joined to the can body 12 through a conventional seaming operation.

The above-described series of steps form the can end 10 with minimal warpage. In particular, the coining operation substantially reduces the direction-dependent nature of the mechanical properties of the can end 10 in the coined area. This direction-dependence, as noted previously, is a result of the rolling operation used to form the blank 50. The direction-dependent properties induce a tendency in the can end 10 to warp. Hence, reducing the direction-dependence of these properties reduces the warpage experienced by the can end 10 as it is formed.

In addition, forming the can end 10 in the above-described manner allows the panel 28 to be coined with little or no increase in the chuck-wall diameter of the can end 10. Applicants have found that initially forming the recessed panel 30 before the coining operation, and then forming the remainder of the recessed panel 30 during the coining operation, minimizes the effect of the coining operation on the chuck-wall diameter. More specifically, coining the area contiguous with the recessed panel 30 while simultaneously forming the recessed panel 30 to its final depth D4 causes substantially all of the material displaced by the coining operation to be driven into the recessed panel 30. The displaced material thereby increases the overall length of the recessed panel 30. The arcuate cross section of the recessed panel 30 allows the recessed panel 30 to undergo such an increase in length without substantially affecting the chuck-wall diameter of the can end 10. In particular, the arcuate cross-section of the recessed panel 30 causes a substantial portion of the displaced material to be driven downward, rather than outward, as the coined panel 28 and the recessed panel 30 are simultaneously formed into their final configurations. Hence, the material displaced by the coining operation adds minimally to the chuck-wall diameter of the can end 10.

The above-described changes in the geometry of the can end 10 are illustrated in FIGS. 6A and 6B. FIG. 6A depicts the can end 10 before the panel 28 is coined. The panel 28 and the recessed panel 30 have an initial combined length denoted by the symbol "L2" in FIG. 6A. The can end 10 has an initial chuck-wall diameter represented by the symbol "D5."

FIG. 6B depicts the can end 10 after the panel 28 has been coined, i.e., FIG. 6B shows the fully-formed can end 10. The material displaced by the coining operation increases the combined length of the coined panel 28 and the recessed panel 30 by an amount represented by the symbol "Δ2." Hence, the combined length of the panels 28 and 30 after the coining operation equals the initial length (L2) plus the increase in length caused by the coining operation (Δ2). The length increase Δ2 does not cause a corresponding increase in the chuck-wall diameter of the can end 10 due the geometry of the recessed panel 30, as explained above. In particular, the increase in the chuck-wall diameter is less than the length increase Δ2 because a substantial portion of the material displaced by the coining operation is driven downward as a result of the geometry of the recessed panel 30.

Applicants have produced the exemplary can end 10 using the above described process. The increase in the chuck-wall diameter of the can end 10 caused by coining the panel 28 was approximately 0.002 inch (0.05 mm), and warpage of the fully-formed can end 10 was approximately 0.015 inch (0.38 mm). These values are both within acceptable limits for production can ends 10. Applicants have also produced a comparable can end without the recessed panel 30. The chuck-wall diameter of this can end increased by approximately 0.006 inch (0.15 mm) as a result of the coining operation. Hence, the use of the invention reduced the change in the chuck-wall diameter of the exemplary can end 10 by approximately two-thirds in relation to a conventionally-formed can end.

The can end 10 can be formed in a die 60 shown in FIGS. 7 through 12B. The die 60, in general, is of a type commonly known to those skilled in the art of making can ends such as the can end 10. Hence, the die 60 will not be described in detail except where necessary for an understanding of the invention.

Structural details of the die 60 are as follows. The die 60 comprises anannular cut edge 62 and a punch 64. The cut edge 62 and the punch 64 are coaxially disposed. The cut edge 62 remains stationary as the can end 10 is formed. The punch 64 is adapted to translate downward, i.e., in the $z^-$ direction, through the cut edge 62. In particular, the punch 64 and the cut edge 62 are sized so that an outer circumferential surface 64*a* of the punch 64 slides vertically along an inner circumferential surface 62*a* of the cut edge 62 (see FIGS. 8 and 9).

The die 60 further comprises an annular pressure ring 66. The pressure ring 66 is substantially aligned with the punch 64 in the vertical (z) direction. The pressure ring 66 is biased upward, i.e., in the $z^+$ direction, by a pneumatic pressure of approximately 40 psi.

The die 60 also includes an annular lower form 68. The lower form 68 is coaxially and translatably disposed within the pressure ring 66. The pressure ring 66 and the lower form 68 are sized so that an inner circumferential surface 66*a* of the pressure ring 66 slides vertically along an outer circumferential surface 68*a* of the lower form 68 (see FIG. 10). The lower form 68 has an upper face 68*b*. The geometric profile of the upper face 68*b* substantially matches the profile of the seaming panel 34 before the seaming panel 34 is joined to the can body 12. The significance of this feature is explained below.

The die 60 further comprises a pressure-ring knock-out 70. The pressure-ring knock-out 70 is coaxially and translatably disposed within the punch 64. The punch 64 and the pressure ring knock-out 70 are sized so that an inner circumferential surface 64*b* of the punch 64 slides vertically along an outer circumferential surface 70*a* of the pressure-ring knock-out 70 (see FIG. 10). The pressure-ring knock-out 70 is substantially aligned with the lower form 68 in the vertical direction. The pressure-ring knock-out 70 is biased downward by a pneumatic pressure of approximately 50 psi.

The die 60 also includes a lift-out lower coin ring 72. The lift-out lower coin ring 72 is coaxially and translatably disposed within the lower form 68. The lift-out lower coin ring 72 is sized so that an outer circumferential surface 72*a* of the ring 72 slides vertically along an inner circumferential surface 68*c* of the lower form 68 (see FIG. 10). The lift-out lower coin ring 72 is biased upward by a pneumatic pressure of approximately 10 psi. The lift-out lower coin ring 72 has an upper surface 72*b*. The upper surface 72*b* includes a substantially flat portion 72*c* and an adjoining curved portion 72*d* (see FIGS. 12A and 12B). The significance of these features is explained below.

The die 60 further comprises an annular upper punch form 74. The upper punch form 74 is coaxially and translatably disposed within the pressure-ring knock-out 70. The upper punch form 74 is sized so that an outer circumferential surface 74*a* of the upper punch form 74 slides vertically along an inner circumferential surface 70*b* of the pressure-ring knock-out 70 (see FIGS. 10 and 11). The upper punch form 74 has a lower surface 74*b*. The lower surface 74*b* includes a substantially flat portion 74*c* and an adjoining curved portion 74*d* (see FIGS. 12A and 12B). The curved portion 74*d* of the lower surface 74*b* has a curvature that is substantially similar to the curvature of the recessed panel 30 of the can end 10. Hence, the curved portion 74*b* has a radius of curvature within the range of approximately 0.035 inches to 0.039 inches (0.89 mm to 0.99 mm). The substantially flat portion 74*c* and the curved portion 74*d* of the upper punch form 74 are substantially vertically aligned with the flat portion 72*c* and the curved portion 72*d*, respectively, of the lift-out lower coin ring 72.

Figure 11:
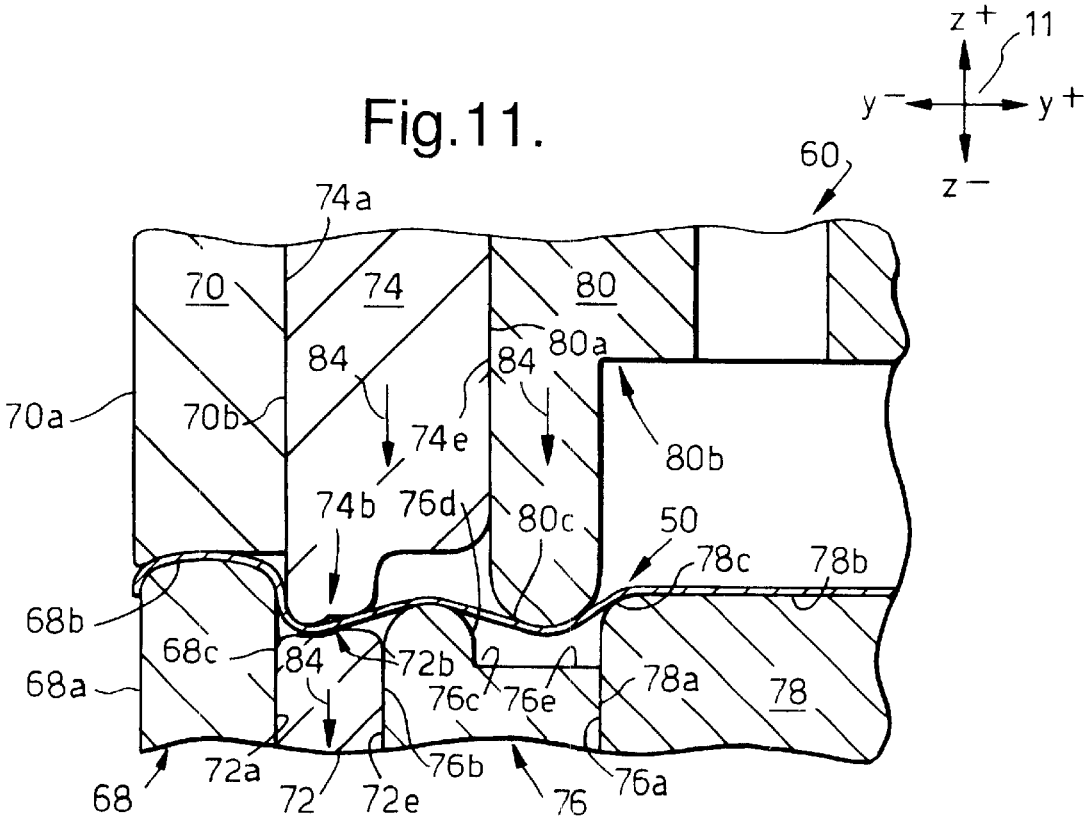
FIG. 11 is a cross-sectional view of the die shown in FIGS. 7 through 10 as stiffening beads are formed in the metal blank shown in FIGS. 9 and 10.

The die 60 also comprises a first lower bead ring 76 and a second lower bead ring 78 (see FIG. 11). The first and the second lower bead rings 76 and 78 remain stationary as the can end 10 is formed. The second lower bead ring 78 is coaxially disposed within the first lower bead ring 76. In particular, an outer circumferential surface 78*a* of the second lower bead ring 78 is fixed to an inner circumferential surface 76*a* of the first lower bead ring 76 (see FIG. 11). Furthermore, the first lower bead ring 76 is sized so that an inner circumferential surface 72*e* of the lift-out lower coin ring 72 slides along an outer circumferential surface 76*b* of the first lower bead ring 76. The first lower bead ring 76 includes an upper surface 76*c* having a curvilinear portion 76*d* and a substantially flat portion 76*e*. The second lower bead ring 78 includes an upper surface 78*b* having a substantially flat profile. The second lower bead ring 78 also includes a rounded corner 78*c* that adjoins the upper surface 78*b*.

The die 60 further comprises an inner upper-form-ring 80 (see FIG. 11). The inner upper-form-ring 80 is coaxially disposed within the upper punch form 74. Specifically, an outer circumferential surface 80*a* of the inner upper-form-ring 80 is fixed to an inner circumferential surface 74*e* of the upper punch form 74. The inner upper-form-ring 80 includes a lower surface 80*b* having a curvilinear portion 80*c*. The curvilinear portion 80*c* is substantially vertically aligned with the substantially flat portion 76*e* of the first lower bead ring 76.

Functional details relating to the die 60 are as follows. The process of forming the can end 10 on the die 60 begins by placing a metal sheet 82 on the die 60 (ss FIG. 8). In particular, the metal sheet 82 is placed on the die 60 so that the metal sheet 82 is substantially supported by the pressure ring 66 and the cut edge 62. The punch 64 subsequently translates downward, into the cut edge 62. (The directions of translation for the various components of the die 60 are denoted by arrows 84 included in the figures.) The movement of the punch 64 into the stationary cut edge 62 cuts the substantially circular blank 50 from the metal sheet 82. More specifically, the punch 64 forms the metal sheet 82 downward. The resulting interference between the metal sheet 82 and the punch 62 cuts (shears) the metal sheet 82 along the inner periphery of the cut edge 62, thereby forming the blank 50 (see FIG. 9). The pressure ring 66 is pushed downward, against its pneumatic bias, in response to the downward movement of the punch 64 as the blank 50 is cut.

The punch 64 continues its downward movement after cutting the blank 50. In addition, the upper punch form 74 translates downward on a simultaneous basis with the punch 64 (see FIG. 10). Furthermore, the pressure ring knock-out 70 applies downward pressure to the blank 50 as a result of its pneumatic bias. The lower form 68 remains stationary, and thereby resists the downward bias of the pressure ring knock-out 70. Hence, a portion of the blank 50 is secured between the pressure ring knock-out 70 and the lower form 68.

Figure 10:
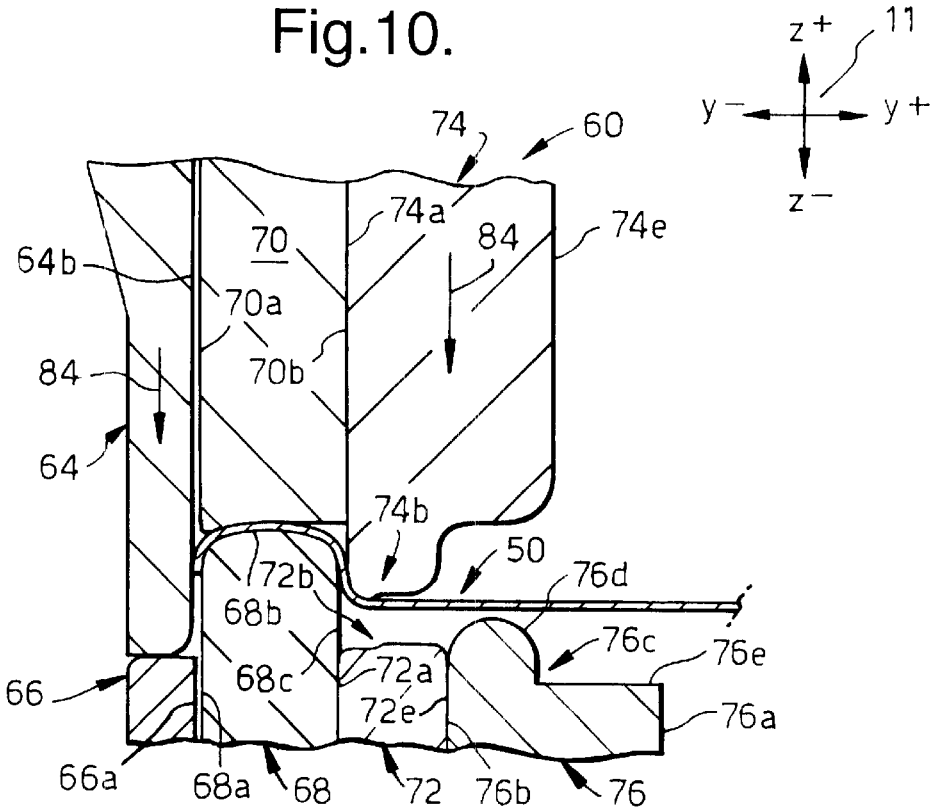
FIG. 10 is a cross-sectional view of the die shown in FIGS. 7 through 9 as a seaming-panel is formed in the metal blank shown in FIG. 9.

The downward movement of the punch 64 and the upper punch form 74 in relation to the lower form 68 stamps the outer periphery of the blank 50 in the manner shown in FIG. 10. In particular, the profile of the upper surface 68*b* of the lower form 68 is stamped into the outer periphery of the blank 50. The profile of the upper surface 68*b* substantially matches the profile of the seaming panel 34, as noted previously. Hence, the noted interaction between the punch 64, the pressure ring knock-out 70, the upper punch form 74, and the lower form 68 forms the seaming panel 34 in the blank 50.

The upper punch form 74 continues its downward movement after the seaming panel 34 is formed. The inner upper-form-ring 80 is fixed to the upper punch form 74, as stated above (see FIG. 11). Hence, the inner upper-form-ring 80 translates downward on a simultaneous basis with the upper punch form 74. The continued downward movement of the upper punch form 74 and the inner upper-form-ring 80 urges the blank 50 downward. The downward movement of the blank 50 causes the blank 50 to deform around the curvilinear portion 76*d* of the first lower bead ring 76 and the rounded corner 78*c* of the second lower bead ring 78. This deformation forms the stiffening beads 22 and 26.

Figure 12A:
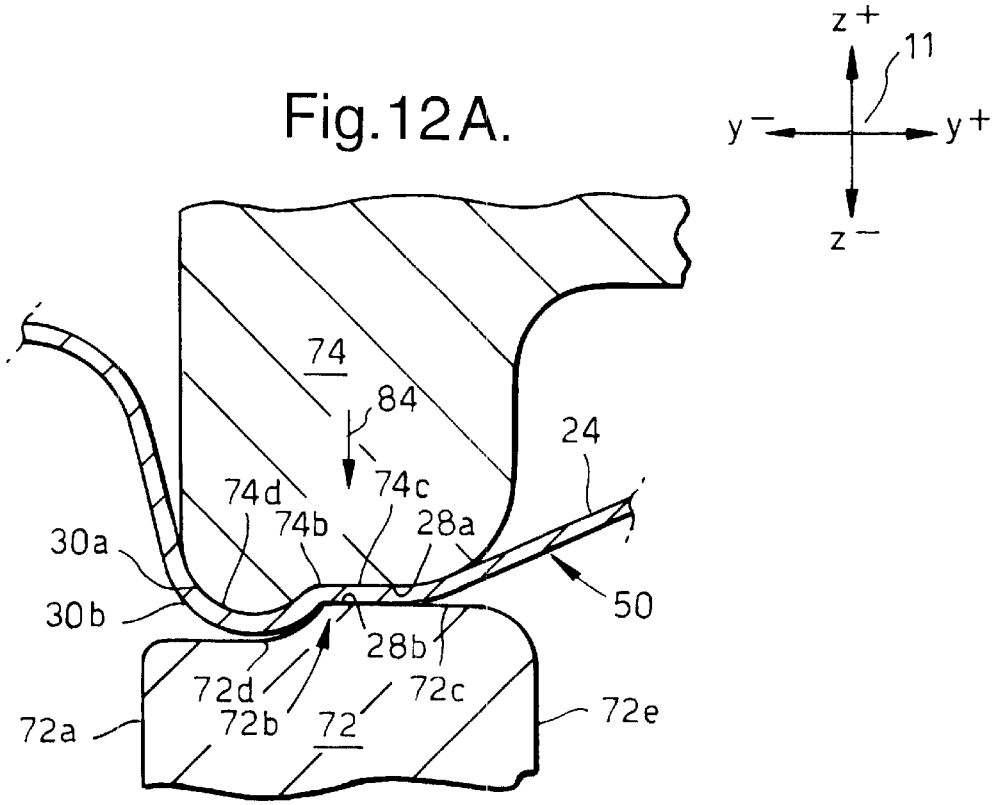
FIG. 12A is a cross-sectional view of the die shown in FIGS. 7 through 11 as a coined panel and a recessed panel are formed in the metal blank shown in FIGS. 9 through 11.
Figure 12B:
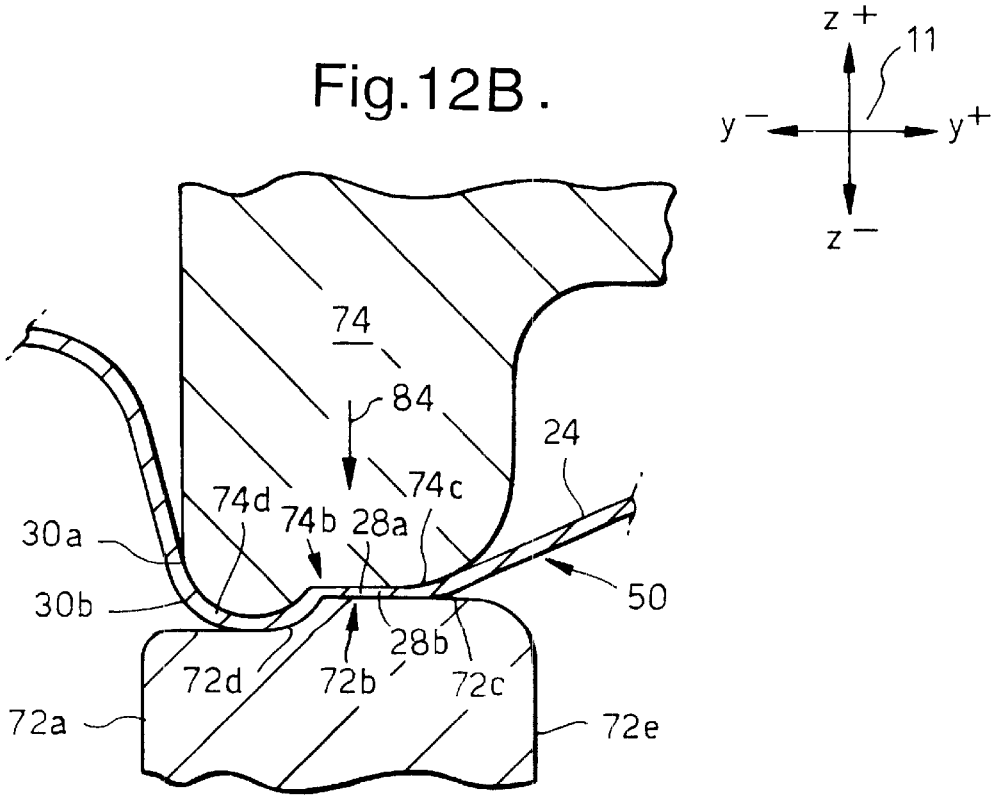
FIG. 12B is a cross-sectional view of the die shown in FIGS. 7 through 12A as a coined panel and a recessed panel are re-formed in the metal blank shown in FIGS. 9 through 12A.
Figure 13A:
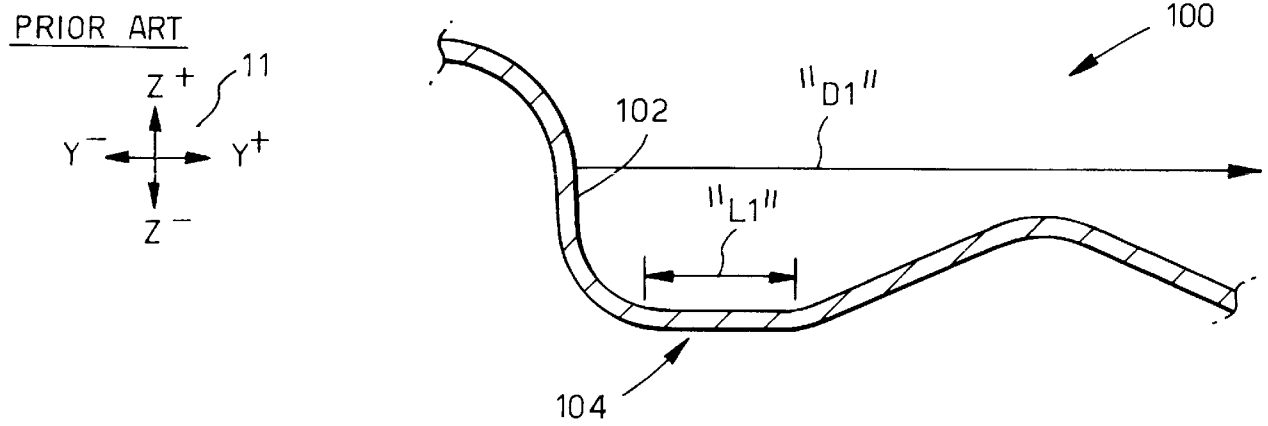
FIG. 13A is a cross-sectional view of a can end prior to being coined using a method in accordance with the prior-art.
Figure 13B:
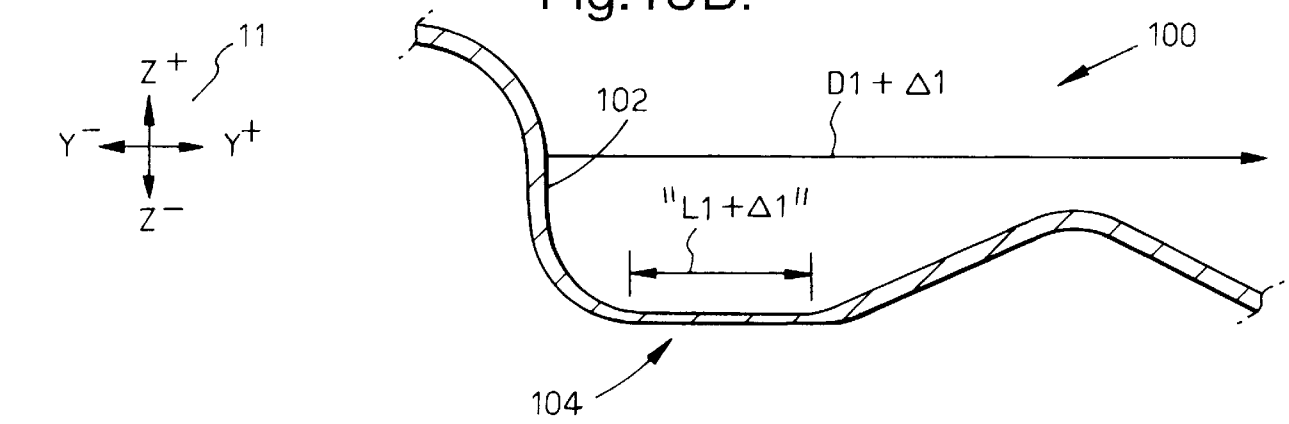
FIG. 13B is a cross-sectional view of the can end shown in FIG. 13A after being coined using the method in accordance with the prior-art.

The continued downward movement of the upper punch form 74 forms the blank 50 into the lift-out lower coin ring 72. The upper punch form 74 and the lift-out lower coin ring 72 act in conjunction to form the coined panel 28 and the recessed panel 30. The coined panel 28 and the recessed panel 30 are formed substantially in two stages, as depicted in FIGS. 12A and 12B. More particularly, the recessed panel 30 and the coined panel 28 are initially formed as shown in FIG. 12A. The recessed panel 30 and the coined panel 28 are subsequently re-formed into their final configurations as depicted in FIG. 12B.

The recessed panel 30 and the coined panel 28 are initially formed as the upper punch form 74 forms the blank 50 into the lift-out lower coin ring 72. Specifically, the downward movement of the upper punch form 74 causes a portion of the blank 50 to become sandwiched between the respective upper surfaces 74*b* and 72*b* of the upper punch form 74 and the lift-out lower coin ring 72. The continued downward movement of the upper punch form 74 drives the lift-out lower coin ring 72 downward, against its pneumatic bias. The lift-out lower coin ring 72 eventually reaches the end of its range of movement. The resistance of the lift-out lower coin ring 72 to further downward movement causes the respective surface portions 74*c* and 72*c* of the upper punch form 74 and the lift-out lower coin ring 72 to substantially flatten the portion of the blank 50 disposed therebetween (see FIG. 12A). This action forms the panel 28 into its initial configuration. Furthermore, a curvilinear profile is imposed on the portion of the blank 50 disposed between the respective curved portions 74*d* and 72*d* of the upper punch form 74 and the lift-out lower coin ring 72, thereby forming the recessed panel 30 and the recess 31.

The continued downward movement of the upper punch form 74 re-forms the panel 28 and the recessed panel 30 into their final configurations. Specifically, the downward movement of the upper punch form 74, in conjunction with the resistance offered by the lift-out lower coin ring 72, coins the panel 28. In addition, the curved portion 74*d* of the upper punch form 74 urges the recessed panel 30 downward until the recessed panel 30 contacts the curved portion 72*d* of the lift-out lower coin ring 72. The recessed panel 30 and the recess 31 are fully formed at this point. This step takes place simultaneously with the coining operation on the panel 28. Applicants have found that re-forming the recessed panel 30 to its final depth D4 while simultaneously coining the panel 28 minimizes any increase in the diameter of the chuck wall 32 resulting from the coining operation, as explained in detail above.

The invention provides substantial advantages in relation to the prior art. For example, the use of the invention allows can ends such as the can end 10 to be manufactured from relatively thin sheets of material. More particularly, the use of the invention substantially reduces the potential for unacceptable warpage in can ends manufactured from relatively thin sheets of rolled metal. The invention thereby facilitates the manufacture of can ends from thinner sheets of material than is feasible with common manufacturing techniques. The use of thinner sheets of material can lead to substantial cost savings due to the large production volumes of typical can ends. In particular, the invention facilitates the use of double-reduced steel in the manufacture can ends such as the can ends 10. Double-reduced steel, as noted previously, provides a favorable combination of thinness, tensile strength, hardness, and resistance to elongation.

Furthermore, reducing or eliminating warpage in a can end such as the can end 10 enhances the fit between the can end 10 and the can body to which the can end is fixed, thereby reducing the potential for leakage into or from the assembled can. The reduction or elimination of warpage also enhances the fit between the can end 10 and the seaming chuck utilized to join the can end 10 to the can body. In addition, reducing or eliminating warpage facilitates the automated transfer (feeding) of the can end 10 during subsequent processing operations, e.g., application of a lining to the can end 10. Other advantages include the ability to implement the invention through relatively minor tooling changes to conventional can-manufacturing equipment. Also, the use of the invention adds little or no time or expense to the manufacturing process for can ends such as the can end 10. In addition, the coining operation enhances the structural integrity the can end 10. In particular, coining the can end 10 increases the overall strength and stability of the can end 10.

It is to be understood that even though numerous characteristics and advantages of the present invention have been set forth in the foregoing description, together with details of the structure and function of the invention, the disclosure is illustrative only, and changes may be made in detail, especially in matters of shape, size, and arrangement of the parts, within the principles of the invention to the full extent indicated by the broad general meaning of the terms in which the appended claims are expressed.

What is claimed is:

1. A method of forming a can end for closing a food can, comprising:

(a) providing a die having an annular cut edge having an inner circumferential surface and a punch coaxially disposed with the cut edge;

(b) forming a substantially circular metal blank having a periphery and a center panel by cooperation of the punch and cut edge of the die;

(c) stamping a seaming panel in the outer periphery of the blank;

(d) forming an upwardly-extending annular stiffening bead and a downwardly-extending stiffening bead on the blank radially outward of the center panel;

(f) forming a substantially annular recessed panel in the blank radially outward of the beads formed in step (d) with a lift-out lower coin ring so that the recessed panel has a first depth relative to a substantially annular portion of the blank contiguously formed with the recessed panel; and (g) coining the substantially annular portion of the blank with the lift-out lower coin ring while re-forming the recessed panel to a second depth relative to the substantially annular portion of the blank, the second depth being greater than the first depth.

2. The method according to claim 1, wherein the first depth of the recessed panel is approximately eighty percent of the second depth of the recessed panel.

3. The method according to claim 1, wherein the first depth of the recessed panel is approximately 0.0635 mm (0.0025") and the second depth is approximately 0.0762 mm (0.0030").

4. The method according to claim 1, wherein the coining step comprises reducing a thickness of the substantially annular portion of the blank by approximately five percent to approximately fifteen percent.

5. The method according to claim 1, wherein the coining step comprises reducing a thickness of the substantially annular portion of the blank from approximately 0.182 mm (0.0072") to a value within a range of approximately 0.157 mm (0.0062") to approximately 0.173 mm (0.0068").

6. The method according to claim 1, wherein forming an annular recessed panel in the blank comprises the step of forming the recessed panel so that the recessed panel has a substantially arcuate cross section.

7. The method according to claim 1, wherein the coining step comprises re-forming the recessed panel so that the recessed panel has a substantially arcuate cross section.

8. The method according to claim 1, wherein an upper surface of the recessed panel has a radius of curvature within a range of approximately 0.889 mm (0.035") to approximately 0.99 mm (0.039") after the recessed panel is re-formed to the second depth.

9. The method according to claim 1, wherein the substantially annular portion (28) of the blank has a width of approximately 1.524 mm (0.06") after the substantially annular portion of the blank is coined.

10. The method according to claim 1, further comprising the step of forming the substantially annular portion of the blank while forming the recessed panel.

11. The method according to claim 1, wherein the step of forming the metal blank comprises cutting the metal blank from a sheet of DR8 65-pound continuous-annealed steel.

12. The method according to claim 1, wherein the step of forming a substantially circular metal blank having a periphery and a center panel comprises cutting the substantially circular metal blank from a sheet of metal.

* * * * *